US009073609B2

(12) United States Patent
Cesario

(10) Patent No.: US 9,073,609 B2
(45) **Date of Patent: *Jul. 7, 2015**

(54) ANCHOR AND KEEL APPARATUS FOR HULL WITH CHANNEL

(76) Inventor: Lucas Cesario, Cape Coral, FL (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/244,632

(22) Filed: Sep. 25, 2011

(65) Prior Publication Data

US 2013/0074754 A1 Mar. 28, 2013

(51) Int. Cl.
*B63B 3/38* (2006.01)
*B63B 21/48* (2006.01)

(52) U.S. Cl.
CPC ..... *B63B 21/48* (2013.01)

(58) Field of Classification Search
USPC ..... 114/140, 230.1, 230.13, 230.15, 114/230.16, 294, 295; 405/1
See application file for complete search history.

(56) References Cited

U.S. PATENT DOCUMENTS

| | | | | |
|---|---|---|---|---|
| 6,041,730 | A * | 3/2000 | Oliverio et al. | 114/294 |
| 7,647,878 | B1 * | 1/2010 | Santiago | 114/294 |
| 7,921,794 | B1 * | 4/2011 | Cullom et al. | 114/294 |
| 7,971,548 | B2 * | 7/2011 | Kuenzel | 114/294 |
| 8,327,791 | B1 * | 12/2012 | Cullom et al. | 114/294 |

* cited by examiner

*Primary Examiner* — Lars A Olson

(57) ABSTRACT

The present invention is directed to an apparatus that allows a boat to be anchored and keeled. The invention has a member that can rotate about a first axis from a stowed position to an anchored position. Or the members may be placed downwardly in the ground floor of the body of water, for keeling. The hull of the vessel has a channel for the rotation or movement of the member within the channel.

5 Claims, 3 Drawing Sheets

ANCHOR AND KEEL APPARATUS FOR HULL WITH CHANNEL

FIELD OF THE INVENTION

This invention relates to an apparatus that can anchor a boat and allow the user to keel the boat.

BACKGROUND OF THE INVENTION

U.S. Pat. No. 7,861,661 to Beaty discloses an "Anchoring system for a kayak." The abstract provides:

> Apparatus is disclosed for anchoring a kayak to the bottom of a body of shallow water. The apparatus includes first and seconds tubes for attachment to the kayak proximate the upper portion of the kayak between the bow and the stern of the kayak, and first and second shafts which are disposed in the proximate seat which comprises two sets of gearing mechanisms for operative engagement with the two shafts, and a rotatable handle which is external to the gear box for operative connection to the first and second gearing mechanisms. First and second actuation devices external to the gear box are provided which have first and second positions, and, in the first position, the actuation devices function to establish operative connection between the first and second gearing mechanisms and a rotatable handle.

This invention requires a gear box and crank to deploy two tubes with shafts attached to each end. The applicant's invention has a simple, single shaft design which swivels about a fixed axis.

U.S. Pat. No. 7,827,927 to Kivi discloses an "Anchoring system for watercraft vessels." The abstract provides:

> An anchoring system for a watercraft vessel, the anchoring system including an anchor bracket configured to be mountable on the watercraft vessel; a sleeve, the sliding tube being at least partially hollow and having a first end and a second end, a rod having a first end disposed within a sliding tube lumen and a second end having a floor contacting tip; the floor contacting tip operable to penetrate the bottom of a creek, lake, river or ocean flat and a retraction member connected to the rod. The retraction member is configured to retract the rod into the sliding tube and retract the sliding tube through the sleeve.

It is positioned on the front, rather than at hand's reach. The goal of this invention is to provide an anchor that enters the water silently and does not drag or snag on the bottom of the body of water.

U.S. Pat. No. 7,270,072 and U.S. Pat. No. 7,270,073 to Waldrop discloses a "Florida anchor." The abstract of U.S. Pat. No. 7,270,072 provides:

> An anchor system designed to quickly anchor and release a boat in shallow water with minimal effort and little to no distraction from other activities such as fishing, which has an anchor sleeve containing a sleeve liner through which an anchor pole with a pointed bottom end passes through, said anchor pole extending below the hull of a boat into the lake or river bottom beneath, and which anchor pole can engage a locking insert when the anchor pole is twisted in either direction, said locking insert located in a notch cut out of the top of the sleeve liner, allowing the anchor to be locked in a stowed position, and which has an upper flange which engages a hand grip wrapped around the top of the anchor pole, preventing the top end of the anchor pole from dropping completely through the boat hull, and which has a bottom flange attached to the boat hull bottom through which the anchor pole passes, and which has an attaching nut which attaches the anchor sleeve to the boat deck.

The object of this invention is to provide a quick and easy way for boat operators to anchor their boats. The most specific use is for boats which have a trolling motor. The design is a single shaft which can be deployed into the water and also stowed in a vertical position on the side of the boat, however, this design is vertical at all times.

U.S. Pat. No. 6,092,484 to Babin et al. discloses a "Marine anchor system." The abstract provides:

> An improved anchor is provided for small boats for mooring in the bottom of bodies of water such as lakes and coastal and inland waters. Embodiments include an anchor comprising a rod, such as a round cross-section stainless steel rod about 3-6 feet long and about 1-2 inches in diameter. One end of the rod is tapered, either to a point or to a blunt hemispherical end, while the other end has a swivel with an eyelet for connecting a shackle rope or chain. A hand grip is provided on the rod between the two ends of the rod. The tapered end of the rod is inserted into the bottom of a body of water using the hand grip. Thus, the anchor easily sets on the first attempt, the swivel accommodates changes in current and wind conditions that may move the boat while it is moored, thereby avoiding dislodging of the anchor and the anchor does not snag on debris.

Here, the user either grips the pole and inserts it into the water or throws it into the water like a spear. Furthermore, one end is attached to a rope or chain which is fixed to the boat. The design allows the boat to swivel about the fixed end in order to accommodate for changes in current and prevent the anchor from dislodging.

U.S. Pat. No. 6,220,197 to Pohlman discloses an "Anchoring and operating device for a watercraft." The abstract provides:

> A device for operating and anchoring in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole.

This invention utilizes a rod with telescoping sections which can easily be extended for use as an anchor or to walk a boat along hazardous conditions. It can then be retracted and stowed in a vertical position. This invention utilizes a spud assembly to lock the rod into place at the desired length.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 anchor and keel apparatus
20 member
30 member retention means
40 flexible cord and ball system
50 member pivoting means
60 lock and lock release
70 ground penetration means
80 aperture
90 member distal end
100 set screw

110 second end
120 point-shaped end
130 screw shaped end
140 extension
150 first axis
160 channel
170 lock pin apparatus
190 collar
200 base
210 point
220 multiple pronged tip
230 extension
240 wing nut screw ring
250 ball and socket joint

SUMMARY OF THE INVENTION

One aspect of the present invention is a an anchor and keel apparatus, for a vessel, comprising: a member pivoting means having a base secured to a vessel and having a collar rotatably disposed on said base; a member slidably disposed within said collar; and a member retention means secured to the vessel in alignment with said member pivoting means so that the member may rotate clockwise and counterclockwise within a channel about a first axis oriented substantially vertical and said first axis also oriented substantially vertical with respect to said member.

Another aspect of the present invention an anchor and keel apparatus for a vessel, comprising: a member pivoting means having a base secured to a vessel and having a collar rotatably disposed on the base; a member slidably disposed within said collar; a member retention means secured to the side of a vessel in alignment with said member pivoting means so that the member may rotate clockwise and counterclockwise within a channel about a first axis oriented substantially vertical and said first axis also oriented substantially vertical with respect to said member; a lock and lock release to allow the member pivoting means to rotate at selected angles and lock the member pivoting means in place; said member has a member distal end that has a replaceable second end; and said member pivoting means is a ball and socket joint.

These and other features, aspects and advantages of the present invention will become better understood with reference to the following drawings, description and claims.

DETAILED DESCRIPTION OF THE INVENTION

Figure 1:
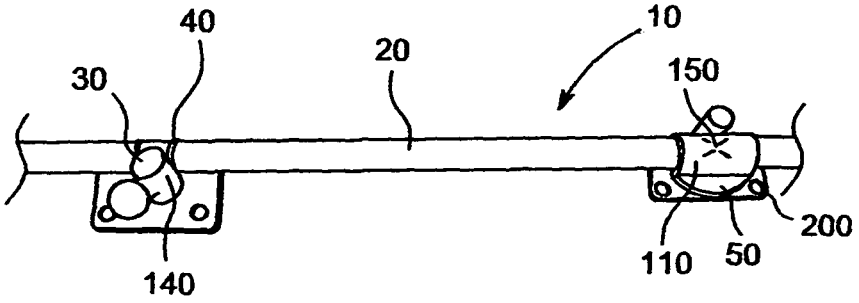
FIG. 1 is a pictorial view of one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

Figure 4:
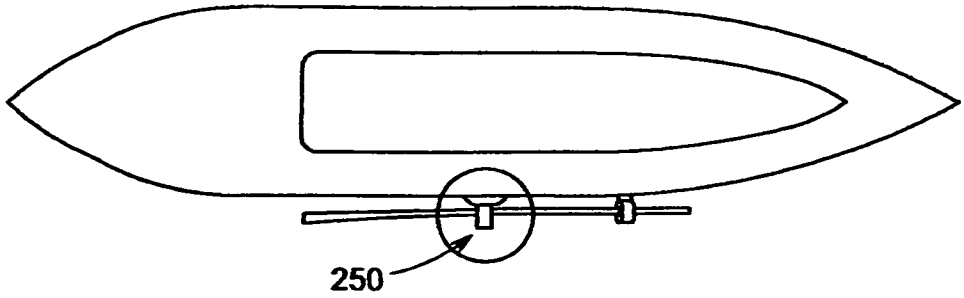
FIG. 4 is a another pictorial view of one embodiment of the present invention.

As seen in FIG. 1, the present invention 10, also called an anchor and keel apparatus 10, discloses an anchor and keel apparatus 10 for a watercraft, such as a boat. The anchor and keel apparatus 10 may be a single shaft 20, also referred to as a member 20, which may terminate at a second end 110, as best seen in FIG. 4. The second end 110 may have a point-shaped end 120 or a screw-shaped end 130 for the purpose of embedding into the bottom of a body of water.

The anchor and keel apparatus 10 may be slidably disposed within a collar 190. The collar 190 that may be integral with a member pivoting means 50 so that the collar 190 can rotate or pivot about a first axis 150. The collar 190 may be rotatably disposed on a base 200 of the member pivoting means 50.

The member 20, when not in use, may be stowed in a substantially horizontal position using a member retention means 30, such as a flexible cord secured to the hull, and can extend over the member 20 and attach to an extension 140 that extends outwardly from hull or vessel. A ball may be attached to the flexible cord, and this type of member retention means 30 may be called a flexible cord and ball system 40. The member retention means 30 may hold the member 10 in contact with the extension to prevent the member 10 from moving.

The flexible cord and ball system 40 can easily be unwrapped, and the member 10 may then pivot or swivel about a fixed axis 150 for deployment into the water.

FIG. 1 also illustrates an embodiment of the member pivoting means 50 which may be secured to the side of a hull of a water craft. The member pivoting means 50 may rotate about a first axis 150, which may be substantially perpendicular with respect to the member 20, so that the member 20 may rotate about the first axis 150. This way the member 20 can be moved from its stowed position when it is secured to the member retention means 30, to any appropriate angle so that the member 20 can contact the bottom surface of a body of water, such as a lake, or anchoring or keeling purposes.

The member pivoting means 50 may be able to be secured at a variety of angular positions via a lock and lock release 60. In one embodiment, the lock and lock release 60 may comprise a pin that is biasly forced toward the hull, so as to be able to be set in a lock pin aperture 170 or several pin apertures 170 to set the member pivoting means 50 at a desired position. For example from the stowed position, when the member 20 is oriented substantially horizontal, the member pivoting means 50 may be rotated about 90 degrees, so that the member 20 is now oriented substantially vertical so that the second end 110 or ground penetration means 70 may be disposed in the ground to anchor the vessel.

Figure 2:
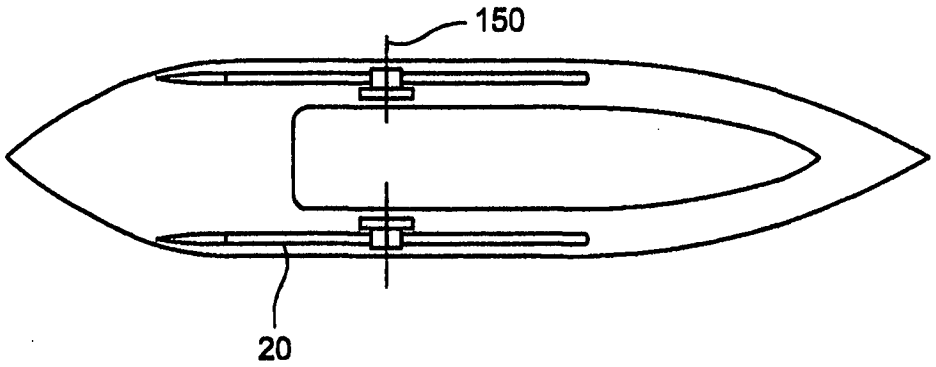
FIG. 2 is another pictorial view of one embodiment of the present invention.
Figure 3:
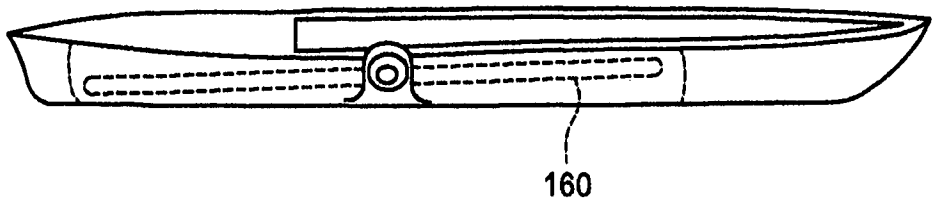
FIG. 3 is another pictorial view of one embodiment of the present invention.

FIGS. 2 and 3 illustrate an embodiment of the member pivoting means 50, which may rotate about a first axis 150. The first axis 150 may extend horizontally away from or through the vessel, to allow the member 20 to be rotated in a clockwise, or counter clockwise direction.

FIG. 1 illustrates an embodiment of the collar 190 of the present invention 10. The member pivoting means 50 may have a base 200 that is secured to the hull of a vessel. A collar 190 may be rotatably disposed on the base 200 so the collar may rotate upon a first axis 150.

FIGS. 2 and 3 illustrate an embodiment of the present invention 10 whereby the member 20 is disposed in a channel 160 within the hull to allow the member 20 to pivot clockwise, or counter clockwise about a first axis 150.

Figure 5:
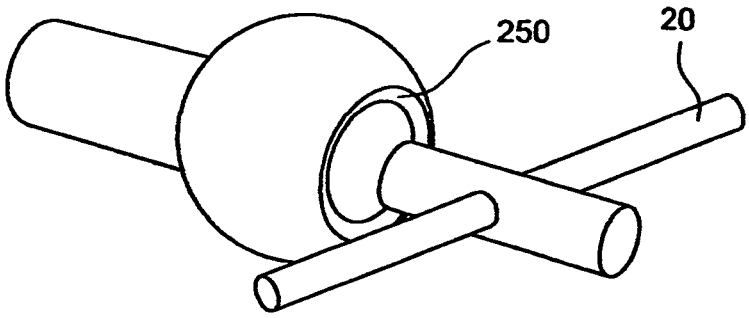
FIG. 5 is another pictorial view of one embodiment of the present invention.

FIGS. 4 and 5 illustrates one embodiment of the member pivoting means 50 whereby the member pivoting means 50 is a ball and socket joint 250 that can allow the member 20 to pivot in an array of directions.

It should be understood, of course, that the foregoing relates to exemplary embodiments of the invention and that modifications may be made without departing from the spirit and scope of the invention as set forth in the following claims.

I claim:

1. An anchor and keel apparatus (10), for a vessel, comprising:

a member pivoting means (50) having a base (200) secured to a vessel and having a collar (190) rotatably disposed on said base (200);

a member (20) slidably disposed within said collar (190); and a member retention means (30) secured to the vessel in alignment with said member pivoting means (50) so that the member (20) may rotate clockwise and counterclockwise within a channel (160) about a first axis (150) oriented substantially horizontal and said first axis (150) also oriented substantially perpendicular with respect to said member (20).

2. The apparatus of claim 1, comprising:

a lock and lock release (60) to allow the member pivoting means (50) to rotate at selected angles and lock the member pivoting means (50) in place.

3. The apparatus of claim 1, whereby said member (20) has a member distal end (90) that has a replaceable second end (110).

4. The apparatus of claim 1, whereby said member pivoting means (50) is a ball and socket joint (250).

5. An anchor and keel apparatus (10) for a vessel, comprising:

a member pivoting means (50) having a base (200) secured to a vessel and having a collar (190) rotatably disposed on the base (200);

a member (20) slidably disposed within said collar (190);

a member retention means (30) secured to the side of a vessel in alignment with said member pivoting means (50) so that the member (20) may rotate clockwise and counterclockwise within a channel (160) about a first axis (150) oriented substantially horizontal and said first axis (150) also oriented substantially perpendicular with respect to said member (20);

a lock and lock release (60) to allow the member pivoting means (50) to rotate at selected angles and lock the member pivoting means (50) in place;

said member (20) has a member distal end (90) that has a replaceable second end (110); and said member pivoting means (50) is a ball and socket joint (250).

* * * * *